US011387553B2

(12) United States Patent
Shao et al.

(10) Patent No.: US 11,387,553 B2
(45) Date of Patent: Jul. 12, 2022

(54) MECHANICAL TRANSMISSION MECHANISM AND BASE STATION ANTENNA

(71) Applicant: CommScope Technologies LLC, Hickory, NC (US)

(72) Inventors: Shuguang Shao, Suzhou (CN); Nengbin Liu, Suzhou (CN); PuLiang Tang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/183,473

(22) Filed: Feb. 24, 2021

(65) Prior Publication Data

US 2021/0288405 A1 Sep. 16, 2021

(30) Foreign Application Priority Data

Mar. 13, 2020 (CN) ..... 202010173134.9

(51) Int. Cl.
*H01Q 3/32* (2006.01)
*H01Q 1/24* (2006.01)

(52) U.S. Cl.
CPC ..... *H01Q 3/32* (2013.01); *H01Q 1/246* (2013.01)

(58) Field of Classification Search
CPC .. H01Q 1/246; H01Q 3/32; H01P 1/18; H01P 1/181; H01P 1/182; H01P 1/184
See application file for complete search history.

(56) References Cited

U.S. PATENT DOCUMENTS

2017/0365923 A1* 12/2017 Schmutzler ..... H01Q 3/005
2021/0159589 A1* 5/2021 Everest ..... H01Q 21/08
2021/0328342 A1* 10/2021 Clifford ..... H01Q 1/246
2021/0336335 A1* 10/2021 Ai ..... H01P 1/18

* cited by examiner

*Primary Examiner* — Daniel Munoz
(74) *Attorney, Agent, or Firm* — Myers Bigel, P.A.

(57) ABSTRACT

The present disclosure relates to a mechanical transmission mechanism and a base station antenna. The mechanical transmission mechanism extends between an actuator and a phase shifter of the base station antenna, and comprises: a first rod driven by the actuator; a second rod for moving a movable element of the phase shifter, the second rod having a proximal end and a distal end; and a link for connecting the first rod and the second rod, the link having a proximal end and a distal end and including a first connecting element that movably connects the first rod with the link and a second connecting element that fixedly connects the second rod with the link; wherein position of the distal end of the second rod relative to the proximal end of the link is adjustable, so that a length of the second rod extending from the proximal end of the link is adjustable, thereby eliminating a virtual displacement caused by mechanical tolerances from the actuator, the mechanical transmission mechanism, and the phase shifter during adjustment of the phase shifter.

32 Claims, 6 Drawing Sheets

MECHANICAL TRANSMISSION MECHANISM AND BASE STATION ANTENNA

RELATED APPLICATIONS

This patent application claims priority to and the benefit of Chinese Patent Application Serial Number 202010173134.9 filed Mar. 13, 2020, the content of which is hereby incorporated by reference as if recited in full herein.

FIELD

The present disclosure relates generally to a communication system. More particularly, the present disclosure relates to a mechanical transmission mechanism extending between an actuator and a phase shifter of a base station antenna, and a base station antenna comprising the mechanical transmission mechanism.

BACKGROUND

Cellular communication systems are used to provide wireless communications to fixed and mobile subscribers. A cellular communication system may include a plurality of base stations, each of which provides a wireless cellular service for a specific coverage area that is typically referred to as a "cell". Each base station may include one or more base station antennas for transmitting radio frequency ("RF") signals to and receiving RF signals from the subscribers that are within the cell served by the base station. Base station antennas are directional devices that can concentrate the RF energy transmitted in or received from certain directions.

Modern base station antennas typically include two, three, or more linear arrays of radiating elements, wherein each linear array has an electronically adjustable down tilt. The linear arrays usually include cross-polarized radiating elements, and a separate phase shifter is provided for electronically adjusting the down tilt of the antenna beam for each polarization, so that the antenna may include twice as many phase shifters as linear arrays. Remote electronic tilt ("RET") actuators and associated mechanical transmission mechanism may be provided in the antenna to adjust the phase shifters.

In order to change the down tilt angle of a linear array of the base station antenna, a control signal may be transmitted to the base station antenna, which causes a RET actuator associated with the linear array to produce a required amount of movement in an output member thereof. The mechanical transmission mechanism is configured to translate the movement of the output member of the RET actuator to movement of a movable element of a phase shifter associated with the linear array. Therefore, each mechanical transmission mechanism may extend between the output member of the RET actuator and the movable element of the phase shifter.

Since related parts of the RET actuator, the mechanical transmission mechanism and the phase shifter inevitably include mechanical tolerances such as manufacturing tolerances and assembly tolerances, when the phase shifter is adjusted by the RET actuator and the mechanical transmission mechanism the phase shifter may not exactly adjust to a desired position due to accumulation of these mechanical tolerances (i.e. the movable element of the phase shifter produces a so-called "virtual displacement"), thereby affecting the adjustment accuracy of the phase shifter. In order to achieve accurate and effective transmission between the RET actuator and the phase shifter and ensure an adjustment accuracy of the phase shifter, it is generally required that related parts of the RET actuator, the mechanical transmission mechanism, and the phase shifter have high machining accuracy, which significantly increases the manufacturing cost.

SUMMARY OF THE INVENTION

Embodiments of the present disclosure provide a mechanical transmission mechanism and a base station antenna including the same that are capable of overcoming at least one defect in the prior art.

The subject matter of the present disclosure will be illustrated according to various aspects described below. For convenience, various examples in various aspects of the subject matter of the present disclosure are described below in this summary. These clauses are provided as examples, rather than limiting the subject matter of the present disclosure.

Embodiments of the invention are directed to a mechanical transmission mechanism extending between an actuator and a phase shifter of a base station antenna. The mechanical transmission mechanism includes: a first rod driven by the actuator; a second rod for moving a movable element of the phase shifter, the second rod having a proximal end and a distal end; and a link for connecting the first rod and the second rod, the link having a proximal end and a distal end and including a first connecting element that movably connects the first rod with the link and a second connecting element that fixedly connects the second rod with the link. A position of the distal end of the second rod relative to the proximal end of the link is adjustable, so that a length of the second rod extending from the proximal end of the link is adjustable, thereby eliminating a virtual displacement caused by mechanical tolerances from the actuator, the mechanical transmission mechanism, and the phase shifter during adjustment of the phase shifter.

The second connecting element of the link can include an inner cavity, and the distal end of the second rod can be extendable into the inner cavity by different distances.

The mechanical transmission mechanism can include an adjusting member for adjusting a distance that the distal end of the second rod extends into the inner cavity.

The adjusting member can be configured to be threadedly connected to the distal end of the second rod and the position of the distal end of the second rod relative to the proximal end of the link can be adjusted by adjusting a distance that the adjusting member is screwed into the distal end of the second rod.

The distal end of the second rod can extend into the inner cavity from a first side of the inner cavity, while at least a portion of the adjusting member can extend into the inner cavity from a second side of the inner cavity opposite the first side.

The mechanical transmission mechanism can also include a limiting member that is configured to restrain the adjusting member after the distal end of the second rod is adjusted to a predetermined position relative to the proximal end of the link and to maintain the predetermined position.

The limiting member can include a first limiting portion for limiting translation of the adjusting member.

The limiting member or the second connecting element of the link can include a second limiting portion for limiting rotation of the adjusting member.

The limiting member can be provided as a snap-fit connection with the link.

The adjusting member can include an extending portion and an end portion. An outer periphery of the end portion of the adjusting member can be provided with a series of ridges or ribs distributed along the outer periphery, and the second limiting portion can be provided with grooves matching the ridges or ribs of the end portion of the adjusting member, thereby limiting rotation of the adjusting member.

The second rod can have a rectangular cross section.

The proximal end of the second rod can include a connecting element for connecting to a movable element of the phase shifter or connecting to a linkage mechanism provided between the second rod and the movable element of the phase shifter.

The connecting element can be located on any side of the rectangular cross section of the second rod.

The connecting element can be configured to be capable of being positioned in a plurality of different orientations.

At least a portion of the second rod can have a circular cross section.

At least a portion of the second rod can be configured to threadably connect to the second connecting element.

The second rod can be provided with an anti-rotation element for limiting rotation of the second rod after the distal end of the second rod is screwed into a predetermined position in the inner cavity so as to maintain the predetermined position.

The first connecting element and the second connecting element can be constructed as a one-piece unit.

The first connecting element and the second connecting element can be constructed as separate elements.

The first connecting element and the second connecting element can be connected by a hinge. The first connecting element and the second connecting element can be configured to be capable of having different included angles.

Yet other embodiments are directed to a mechanical transmission mechanism extending between an actuator and a phase shifter of a base station antenna. The mechanical transmission mechanism includes: a rod for moving a movable element of the phase shifter, the rod having a proximal end and a distal end; and a link having a proximal end and a distal end and including a first connecting element for movably connecting with an output member of the actuator and a second connecting element for fixedly connecting with the rod. A position of the distal end of the rod relative to the proximal end of the link is adjustable, so that a length of the rod extending from the proximal end of the link is adjustable, thereby eliminating a virtual displacement caused by mechanical tolerances from the actuator, the mechanical transmission mechanism, and the phase shifter during adjustment of the phase shifter.

The mechanical transmission mechanism can include an adjusting member for adjusting the position of the distal end of the rod relative to the proximal end of the link.

The mechanical transmission mechanism can further include a limiting member that can be configured to restrain the adjusting member after the distal end of the rod is adjusted by the adjusting member to a predetermined position relative to the proximal end of the link and to maintain the predetermined position.

The adjusting member can be constructed as an adjusting screw including an extending portion and an end portion. The extending portion of the adjusting screw is configured to be threadedly connected with the distal end of the rod, so as to adjust the position of the distal end of the rod relative to the proximal end of the link by adjusting a distance that the extending portion is screwed into the distal end of the rod.

The second connecting element of the link can include an inner cavity. The distal end of the rod can extend into the inner cavity from a first side of the inner cavity, while the extending portion of the adjusting screw extends into the inner cavity from a second side of the inner cavity opposite the first side.

An outer periphery of the end portion of the adjusting screw can be provided with a series of ridges or ribs distributed along the outer periphery, and the limiting member can be provided with grooves matching the ridges or ribs of the end portion of the adjusting screw, thereby limiting rotation of the adjusting screw.

The limiting member can further include a limiting portion that is configured to limit translation of the adjusting screw.

The limiting member can be provided as a snap-fit connection with the link.

The rod can have a rectangular cross section.

The proximal end of the rod can include a connecting element located on any side of the rectangular cross section of the rod.

Yet other embodiments are directed do a base station antenna. The base station antenna includes: an actuator; a phase shifter having a movable element; and the mechanical transmission mechanism according to any one of clauses above. The first rod of the mechanical transmission mechanism is connected to the actuator, and the second rod of the mechanical transmission mechanism is connected to the movable element of the phase shifter or a linkage mechanism provided between the second rod and the movable element of the phase shifter.

Still other embodiments are directed to a base station antenna that includes: an actuator; a phase shifter having a movable element; and the mechanical transmission mechanism according to any one of the above clauses. The first connecting element of the link of the mechanical transmission mechanism is connected to an output member of the actuator, and the rod of the mechanical transmission mechanism is connected to the movable element of the phase shifter or a linkage mechanism provided between the rod and the movable element of the phase shifter.

It is to be noted that, various aspects of the present disclosure described with respect to one embodiment, although not specifically described with respect to other different embodiments, may be incorporated into the other different embodiments. In other words, all embodiments and/or features of any embodiment may be combined in any manner and/or combination, as long as they are not contradictory to one another.

BRIEF DESCRIPTION OF THE DRAWINGS

After reading the embodiments hereinafter in conjunction with the accompanying drawings, a plurality of aspects of the present disclosure will be better understood, wherein.

It should be understood that, in all the drawings, the same reference signs refer to the same elements. In the drawings, for the sake of clarity, sizes of certain features may be modified and may not be drawn to scale.

DETAILED DESCRIPTION

Figure 1:
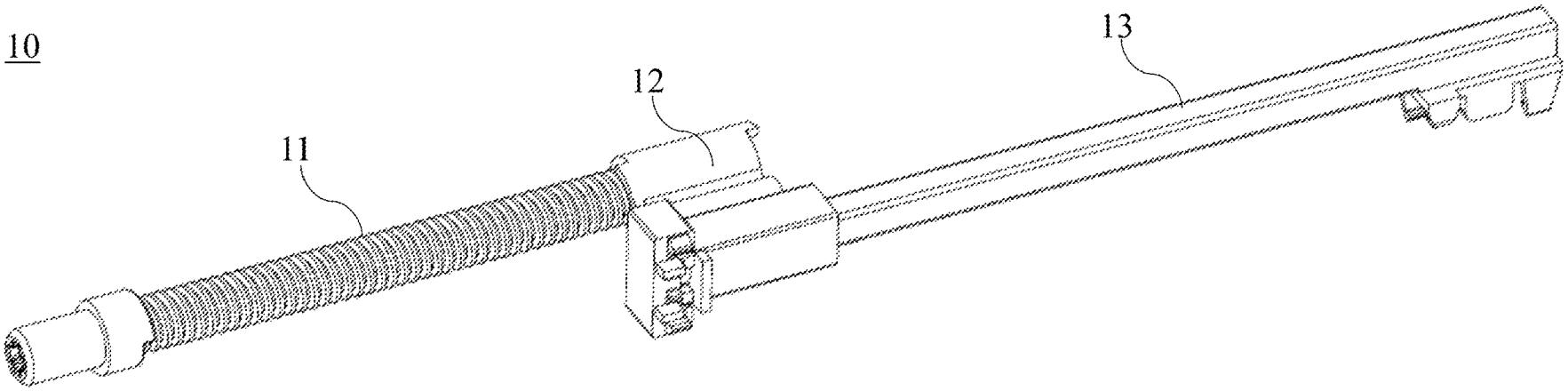
FIG. 1 shows a perspective view of a mechanical transmission mechanism according to one embodiment of the present disclosure.

The present disclosure will be described below with reference to the drawings, in which several embodiments of the present disclosure are shown. It should be understood, however, that the present disclosure may be presented in multiple different ways, and not limited to the embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein may be combined in various ways to provide more additional embodiments.

It should be understood that the specification is used for describing particular embodiments and is not intended to define the present disclosure. All the terms used in the specification (including the technical terms and scientific terms) have meanings as normally understood by a person skilled in the art, unless otherwise defined. For the sake of conciseness and/or clarity, the well-known functions or constructions may not be described in detail any longer.

The singular forms "a/an", "said" and "the" as used in the specification, unless clearly indicated, all contain the plural forms. The wordings "comprising", "containing" and "including" used in the specification indicate the presence of the claimed features, but do not expel the presence of one or more other features. The wording "and/or" as used in the specification includes any and all combinations of one or more of the relevant items listed.

The phases "between X and Y" and "between about X and Y" as used in the specification should be construed as including X and Y. The phrase "between about X and Y" as used in the present specification means "between about X and about Y", and the phrase "from about X to Y" as used in the present specification means "from about X to about Y".

In the specification, when one element is referred to as being "on" another element, "attached to" another element, "connected to" another element, "coupled to" another element, or "in contact with" another element, the element may be directly located on another element, attached to another element, connected to another element, coupled to another element, or in contact with another element, or there may be present with an intermediate element.

In the specification, the terms "first" and "second" are used for convenient description only but not intended to be restrictive. Any technical features represented by "first" and "second" are interchangeable.

In the specification, the spatial relation wordings such as "up", "down", "forth", "back", "top", "bottom" and the like may describe a relation of one feature with another feature in the drawings. The spatial relation wording also contain different orientations of the apparatus in use or operation, in addition to containing the orientations shown in the drawings. For example, when the apparatus in the drawings is overturned, the features previously described as "below" other features may be described to be "above" other features at this time. The apparatus may also be otherwise oriented (rotated 90 degrees or at other orientations). At this time, the relative spatial relations will be explained correspondingly.

In the specification, the term "proximal" refers to one side proximate to the phase shifter, and the term "distal" refers to one side remote from the phase shifter.

The present disclosure relates to a mechanical transmission mechanism extending between an actuator (e.g., a RET actuator) and a phase shifter of a base station antenna, which is configured to translate actuation of the actuator or movement of an output member of the actuator to movement of a movable element of the phase shifter associated with the linear array of the base station antenna. The mechanical transmission mechanism according to the present disclosure may include at least a link and a push-pull rod that is fixedly connectable to the link, wherein the push-pull rod is configured to move a movable element of the phase shifter. In embodiments according to the present disclosure, the push-pull rod itself may have a constant length. However, the length of the push-pull rod extending from one end of the link may be changed. By changing the length of the push-pull rod extending from one end of the link, a total mechanical tolerance (which is accumulated by manufacturing tolerance, assembly tolerance and the like of each part) of the entire transmission system from an actuator to a movable element of a phase shifter of the base station antenna may be compensated, thereby effectively eliminating the "virtual displacement" caused by the total mechanical tolerance during the adjustment of the phase shifter and thus ensuring the adjustment accuracy of the phase shifter. In the present disclosure, the "virtual displacement" refers to a displacement deviation between an actual displacement and a predetermined displacement of the movable element of the phase shifter.

Figure 2A:
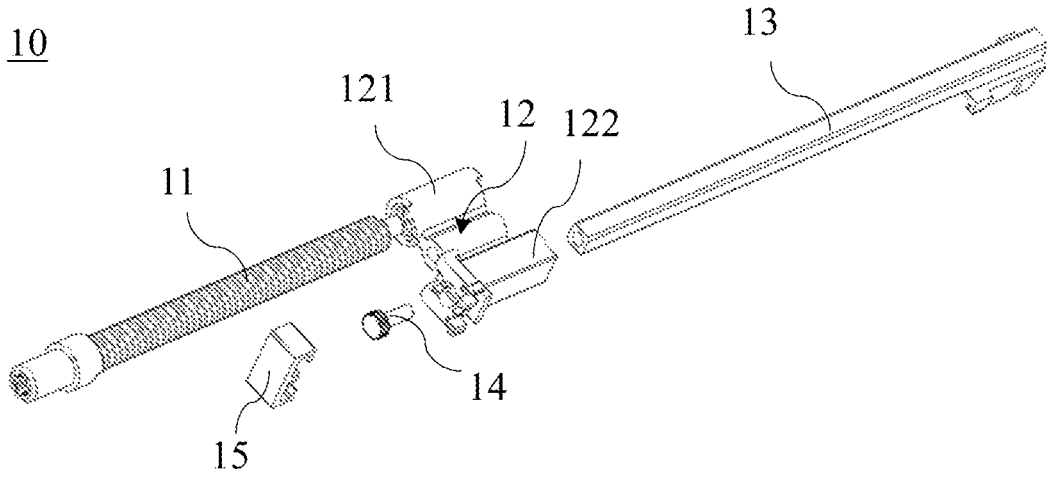
FIGS. 2*a* and 2*b* show exploded perspective views of a mechanical transmission mechanism according to one embodiment of the present disclosure from different angles, respectively.
Figure 2B:
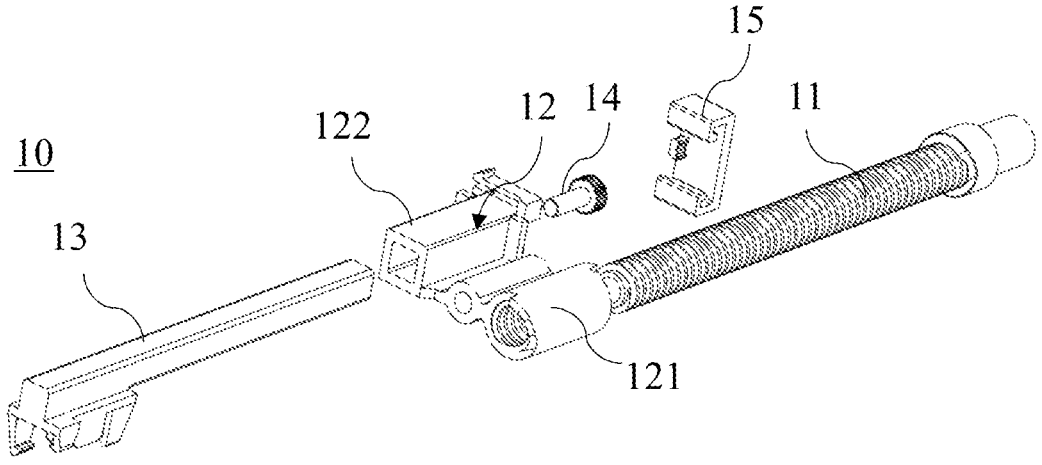

The embodiments of the present disclosure will now be discussed in more detail with reference to the accompanying drawings. FIG. 1 shows a perspective view of a mechanical transmission mechanism according to one embodiment of the present disclosure. FIGS. 2*a* and 2*b* show exploded perspective views of a mechanical transmission mechanism according to one embodiment of the present disclosure from different angles. As shown in FIGS. 1 to 2*b*, the mechanical transmission mechanism 10 according to the present disclosure may include a transmission rod 11, a link 12, and a push-pull rod 13. The transmission rod 11 may be connected to and driven by an actuator (e.g., a RET actuator) of the base station antenna. The transmission rod 11 may also be an output member of the actuator of the base station antenna. The transmission rod 11 may be a threaded rod driven by a motor of the actuator, which may be driven by the motor to rotate. The push-pull rod 13 may be directly connected to the movable element of the phase shifter of the base station antenna, or indirectly connected to the movable element of the phase shifter via an additional linkage mechanism provided between the push-pull rod 13 and the movable element of the phase shifter.

The transmission rod 11 and the push-pull rod 13 are connected by the link 12. The link 12 may include a first connecting element 121 for movably connecting the transmission rod 11 to the link 12 and a second connecting element 122 for fixedly connecting the push-pull rod 13 to the link 12. Specifically, the first connection element 121 may be constructed as a sleeve having an internal thread, and correspondingly, the transmission rod 11 may be constructed as a threaded rod having an external thread. The sleeve may be mounted on the threaded rod and configured to move axially relative to the threaded rod when the threaded rod rotates, so that the transmission rod 11 is movably connected to the link 12. The second connecting element 122 may be configured to include an inner cavity 1221 (see FIGS. 3*a*-3*b*), and a distal end of the push-pull rod 13 may extend into and be fixed in place within the inner cavity 1221 so that the push-pull rod 13 is fixedly connected to the link 12.

The first connecting element 121 and the second connecting element 122 are arranged along a direction perpendicular to a length direction of the transmission rod 11 or the push-pull rod 13. As shown more clearly in FIGS. 3*a* to 3*c*, the first connecting element 121 and the second connecting element 122 may be constructed as one-piece, and the first connecting element 121 and the second connecting element 122 are in substantially the same plane. However, the present disclosure is not limited thereto. The first connecting element 121 and the second connecting element 122 may also be constructed as separate elements, which are then connected together in an appropriate way such as welding, hinging, adhesion, snap-fit connection, bolt connection or the like. The first connecting element 121 and the second connecting element 122 may also be configured to have an included angle with each other, which facilitates the push-pull rod 13 to offset relative to the transmission rod 11 to an appropriate installation position. In some embodiments, the first connecting element 121 and the second connecting element 122 are connected by a hinge, so that the first connecting element 121 and the second connecting element 122 can have different included angles, which further increases the versatility of the link 12 and facilitates the push-pull rod 13 to offset relative to the transmission rod 11 to more appropriate installation positions. After the first connecting element 121 and the second connecting element 122 are moved to a desired included angle, the first connecting element 121 and the second connecting element 122 may be locked in place by a locking mechanism to maintain the desired included angle.

Figure 3A:
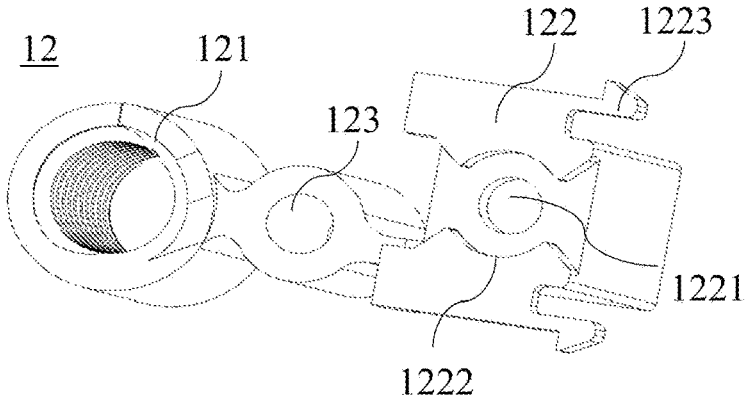
FIGS. 3*a* to 3*c* show a perspective view, a front view, and a rear view of a link of a mechanical transmission mechanism according to one embodiment of the present disclosure, respectively.
Figure 3B:
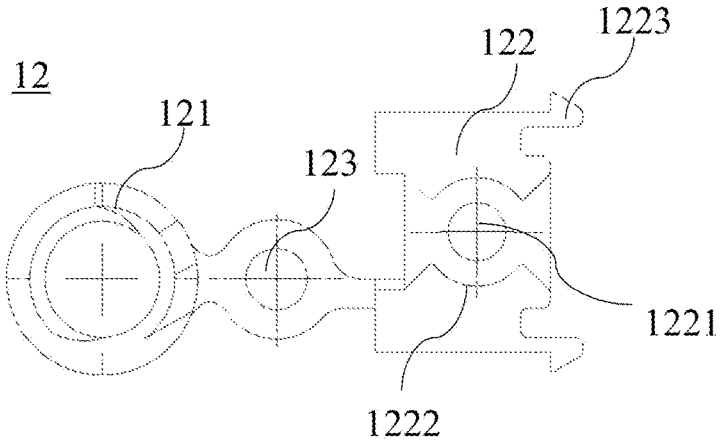
Figure 3C:
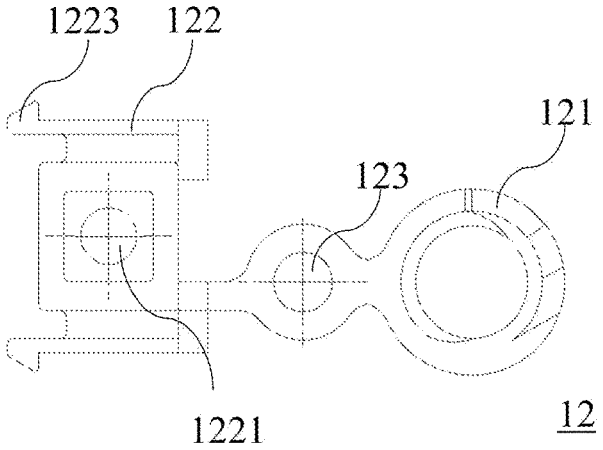

As shown in FIG. 3*a* to FIG. 3*c*, a guide hole 123 through which a guide element (e.g., a guide rod) passes may be further provided between the first connecting element 121 and the second connecting element 122. The central axis of the guide hole 123 is maintained to be parallel to the central axes of both the internally threaded sleeve of the first connecting element 121 and the internal cavity 1221 of the second connecting element 122. The guide element passes through the guide hole 123 for preventing rotation of the first connecting element 121 along with rotation of the transmission rod 11 during the operation of the mechanical transmission mechanism, while allowing the first connecting element 121 (and thus the entire link 12) to move axially on the transmission rod 11.

Returning to FIGS. 1 to 2*b*, in order to compensate the total mechanical tolerance of the entire transmission system from the actuator to the movable element of the phase shifter of the base station antenna and thus to eliminate the virtual displacement of the movable member of the phase shifter caused by the total mechanical tolerance, the distal end of the push-pull rod 13 may extend into the inner cavity 1221 by different distances, so that position of the distal end of the push-pull rod 13 relative to the proximal end of the link 12 may be adjusted, and therefore the length of the proximal end of the push-pull rod 13 extending from the proximal end of the link 12 can be adjusted. In other words, an overall length of the mechanical transmission system according to the present disclosure is configured to be adjustable, so that the total mechanical tolerance of the entire transmission system from the actuator to the movable element of the phase shifter of the base station antenna can be compensated.

Figure 4A:
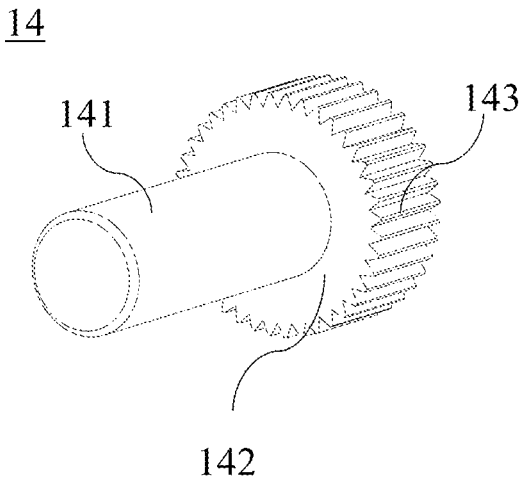
FIGS. 4*a* and 4*b* show perspective views of an adjusting member and a limiting member according to one embodiment of the present disclosure, respectively.

In the embodiments shown in FIGS. 1 to 2*b*, the position of the distal end of the push-pull rod 13 relative to the proximal end of the link 12 is adjusted using an adjusting member 14. The adjusting member 14 may be constructed as an adjusting screw. The adjusting screw may include an extending portion 141 and an end portion 142 (see FIG. 4*a*). The extending portion 141 of the adjusting screw is configured to be threadedly connected to the distal end of the push-pull rod 13, and the position of the distal end of the push-pull rod 13 relative to the proximal end of the link 12 is adjusted by adjusting a distance in which the extending portion 141 is screwed into the distal end of the push-pull rod 13. During assembly, the distal end of the push-pull rod 13 extends into the inner cavity 1221 of the second connecting element 122 from one side of the link 12, while the extending portion 141 of the adjusting screw extends into the inner cavity 1221 of the second connecting element 122 from the other side of the link 12 and is threadedly connected to the distal end of the push-pull rod 13. The size of the end portion 142 of the adjusting screw may be greater than that of the extending portion 141 to prevent the end portion 142 of the adjusting screw from entering the inner cavity 1221. In this way, by adjusting the distance of the extending portion 141 of the adjusting screw being screwed into the distal end of the push-pull rod 13, the distance of the distal end of the push-pull rod 13 extending into the inner cavity 1221 may be adjusted, so that the length of the push-pull rod 13 extending from the inner cavity 1221 (or the proximal end of the link 12) may be adjusted, thereby eliminating the virtual displacement caused by the total mechanical tolerance.

A fine adjustment may be obtained by implementing adjustment by way of a threaded connection between the adjusting member 14 and the push-pull rod 13. The amount of adjustment caused by each rotation of the adjusting member 14 is substantially equal to a pitch of adjacent threads on the extending portion 141 of the adjusting member 14. Therefore, according to actual needs, it is possible to properly determine adjustment increment of the push-pull rod 13 by selecting a pitch of adjacent threads provided on the extending portion of the adjusting member 14, and thus to achieve a desired adjustment accuracy or to even implement stepless adjustment. Of course, the present disclosure is not limited thereto, and various other adjustment manners may be conceived.

Figure 4B:
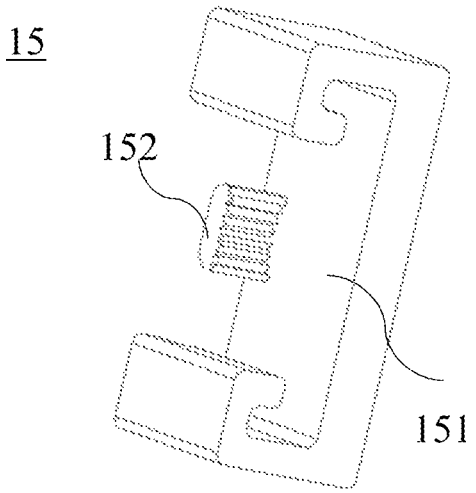

After the adjusting member 14 adjusts the push-pull rod 13 to a predetermined position relative to the link 12, it is possible to restrain the adjusting member 14 by a limiting member 15 and thus maintain the predetermined position. The limiting member 15 may include a first limiting portion 151 for limiting the translation or axial movement of the adjusting member 14 and a second limiting portion 152 for limiting the rotation of the adjusting member 14. As shown more clearly in FIGS. 4*a* and 4*b*, the first limiting portion 151 may be the inner end surface of the limiting member 15, which may abut against the outer end surface of the end portion 142 of the adjusting member 14, thereby clamping the adjusting member 14 between the second connecting element 122 and the limiting member 15. The second limiting portion 152 may be a protruding portion extending from the inner end surface of the limiting member 15 and configured to prevent rotation of the adjusting member 14. Specifically, an outer periphery of the end portion 142 of the adjusting member 14 may be provided with a series of ridges or ribs 143 distributed along the outer periphery. Correspondingly, the second limiting portion 152 may be provided with grooves matching the ridges or ribs 143 of the end portion 142 of the adjusting member 14. In this way, by inserting the ridges or ribs 143 of the adjusting member 14 into the grooves of the second limiting portion 152 of the limiting member 15, the rotation of the adjusting member 14 is limited.

In other embodiments according to the present disclosure, the limiting member 15 may include only the first limiting portion 151 for limiting the translation or axial movement of the adjusting member 14, while the second limiting portion 152 for limiting the rotation of the adjusting member 14 may be disposed on the second connecting element 122. In addition, those skilled in the art may also conceive a limiting member with other appropriate structures.

Figure 5A:
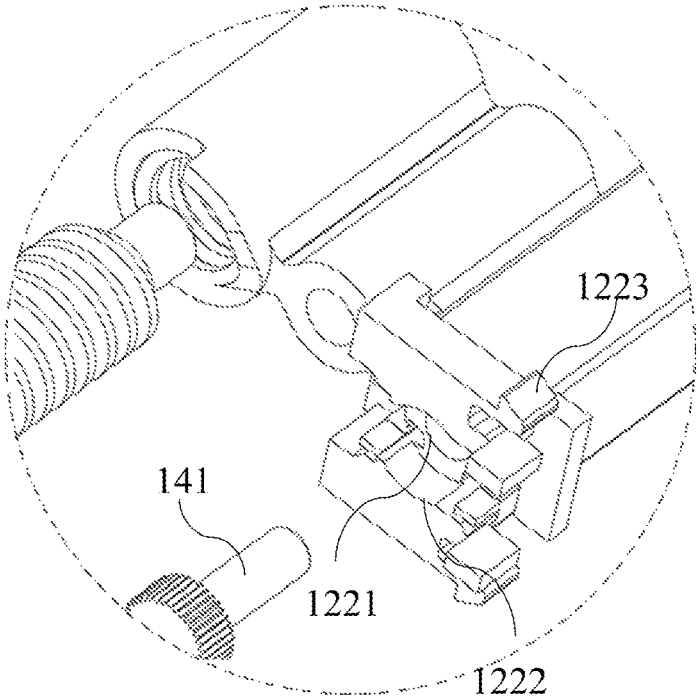
FIGS. 5*a* and 5*b* show a schematic view of assembling an adjusting member and a limiting member on a link according to one embodiment of the present disclosure, respectively.
Figure 5B:
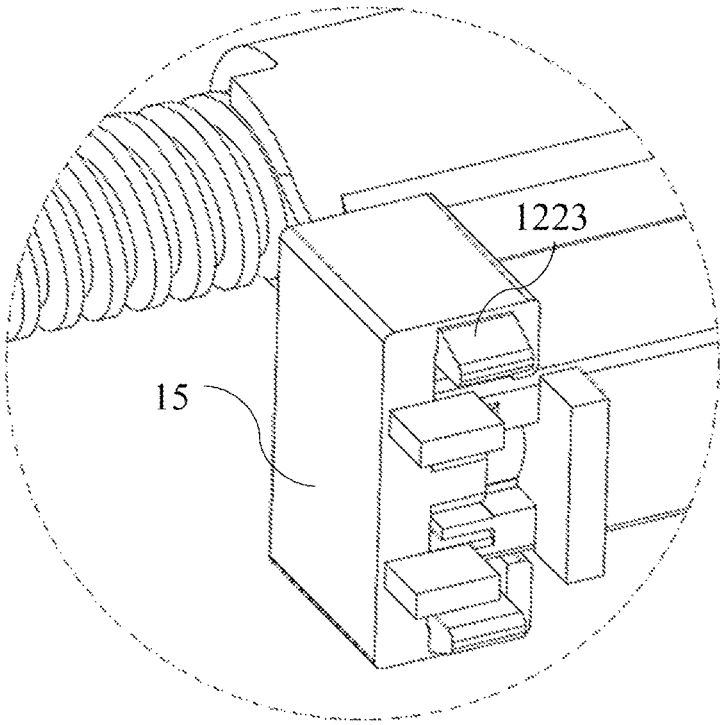

FIGS. 5*a* and 5*b* show the assembly of the adjusting member 14 and the limiting member 15 on the second connecting element 122 of the link 12. As shown in FIG. 5*a*, the extending portion 141 of the adjusting member 14 may extend into the inner cavity 1221 of the second connecting element 122, while the end portion 142 of the adjusting member 14 may be received in the receiving seat 1222 of the second connecting element 122 and prevented from entering the inner cavity 1221. The limiting member 15 may be configured to be in snap-fit connection with the second connecting element 122, so as to sandwich the end portion 142 of the adjusting member 14 between the second connecting element 122 and the limiting member 15 (as shown in FIG. 5*b*). The second connecting element 122 may be provided with snap clips 1223 to achieve the snap-fit connection with the limiting member 15.

Figure 6:
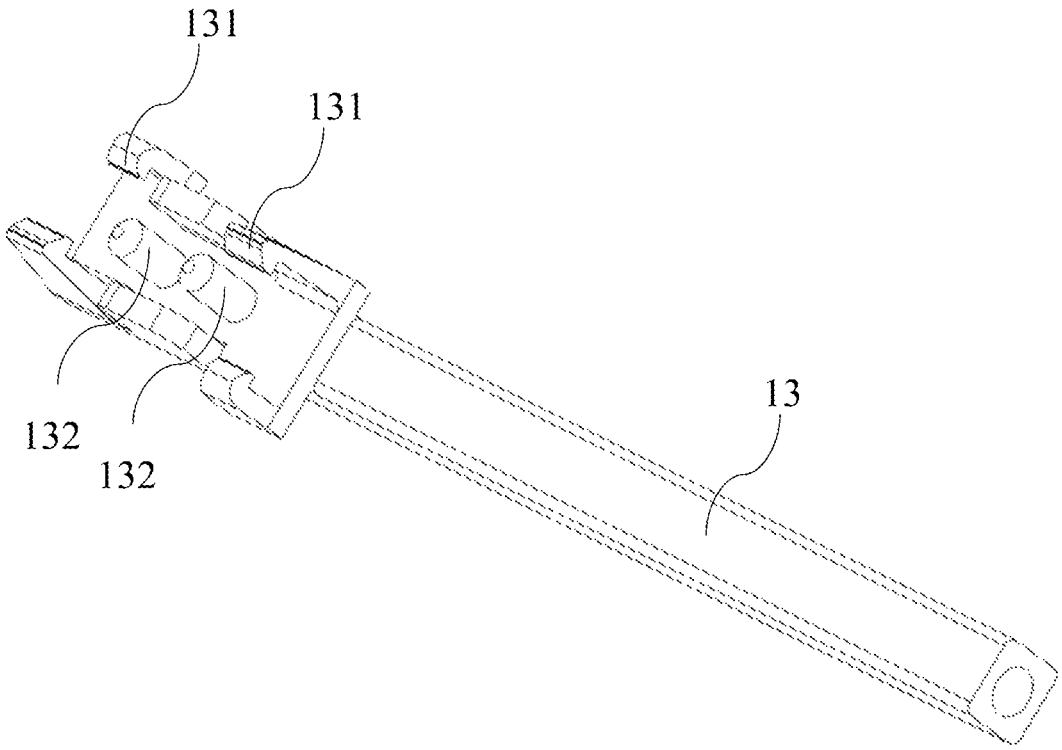
FIG. 6 shows a perspective view of a push-pull rod according to one embodiment of the present disclosure.

Referring to FIG. 6, a specific structure of the push-pull rod 13 according to one embodiment of the present disclosure is shown. In this embodiment, the push-pull rod 13 has a substantially rectangular cross section. The proximal end of the push-pull rod 13 may be provided with one or more snap-fit elements 131 and posts 132, for connection with the movable elements of the phase shifter or other linkage mechanisms provided between the push-pull rod 13 and the movable elements of the phase shifter. The snap-fit elements 131 may be constructed in the form of snap clips. The post 132 may be inserted into the hole of the movable element or other linkage mechanisms of the phase shifter, and the snap-fit element 131 may hold the movable element or other linkage mechanisms of the phase shifter in place after the post 132 is inserted into the hole of the movable element or other linkage mechanisms of the phase shifter. The snap-fit elements 131 and the posts 132 may be disposed on any side of the rectangular cross section of the push-pull rod 13. In this embodiment, in order to receive the push-pull rod 13 having a rectangular cross section, at least a portion of the inner cavity 1221 of the second connecting element 122 is rectangular. The push-pull rod 13 can extend into the rectangular portion of the inner cavity 1221 of the second connecting element 122 along the axial direction, but cannot rotate therein. When the push-pull rod 13 is inserted into the inner cavity 1221, the snap-fit elements 131 and the posts 132 of the push-pull rod 13 may be positioned in an appropriate orientation according to actual needs. In other words, the snap-fit elements 131 and the posts 132 of the push-pull rod 13 may be positioned in at least four different orientations (up, down, front, and rear), which can reduce the difficulty of arranging the phase shifter.

In other embodiments according to the present disclosure, at least a portion of the distal end of the push-pull rod 13 may be configured to have a cross section in other polygonal shapes such as pentagonal, hexagonal, and octagonal shapes. Accordingly, at least a portion of the inner cavity 1221 of the second connection element 122 has a corresponding polygonal shape. In this way, when the push-pull rod 13 is inserted into the inner cavity 1221, the snap-fit elements 131 and the posts 132 of the push-pull rod 13 may be positioned in more orientations according to actual needs, thereby further reducing the difficulty of arranging the phase shifter.

In another embodiment according to the present disclosure, the mechanical transmission mechanism 10 may not include the separate adjusting member 14. In this embodiment, the push-pull rod 13 and the second connecting element 122 may be constructed in a threaded connection. For example, at least a portion of the distal end of the push-pull rod 13 may have a circular cross section and have an external thread thereon, and the inner cavity 1221 of the second connecting element 122 may be circular and have an internal thread therein. The distal end of the push-pull rod 13 may be directly screwed into the inner cavity 1221 of the second connecting element 122 by different distances. In this embodiment, the limiting member 15 may be disposed on the push-pull rod 13 for restraining the push-pull rod 13 after the push-pull rod 13 rotates to a predetermined position and thus maintaining the predetermined position. The limiting member 15 may be any anti-rotation element, such as a self-locking nut. In yet another embodiment, the distal end of the push-pull rod 13 may have an enlarged circular cross section that defines a cavity having internal threads, and the second connecting element 122 may be circular and have external threads. In the case where one or more snap-fit elements 131 and the posts 132 are provided at the proximal end of the push-pull rod 13, the snap-fit elements 131 and the posts 132 may have any orientation, so that the push-pull rod 13 can realize a 360° snap-fit connection, thereby significantly reducing the difficulty of arranging the phase shifter.

The exemplary embodiments according to the present disclosure have been described above with reference to the accompanying drawings. However, those skilled in the art should appreciate that a plurality of changes and modifications may be made to the exemplary embodiments of the present disclosure without departing from the spirit and scope of the present disclosure. All the changes and modifications are encompassed within the protection scope of the present invention as defined by the claims. The present invention is defined by the appended claims, and the equivalents of these claims are also contained therein.

What is claimed is:

1. A mechanical transmission mechanism extending between an actuator and a phase shifter of a base station antenna, wherein the mechanical transmission mechanism comprises:

a first rod driven by the actuator;

a second rod for moving a movable element of the phase shifter, the second rod having a proximal end and a distal end; and a link for connecting the first rod and the second rod, the link having a proximal end and a distal end and including a first connecting element that movably connects the first rod with the link and a second connecting element that fixedly connects the second rod with the link;

wherein a position of the distal end of the second rod relative to the proximal end of the link is adjustable, so that a length of the second rod extending from the proximal end of the link is adjustable, thereby eliminating a virtual displacement caused by mechanical tolerances from the actuator, the mechanical transmission mechanism, and the phase shifter during adjustment of the phase shifter.

2. The mechanical transmission mechanism according to claim 1, wherein the second connecting element of the link includes an inner cavity, and the distal end of the second rod is extendable into the inner cavity by different distances.

3. The mechanical transmission mechanism according to claim 2, wherein the mechanical transmission mechanism includes an adjusting member for adjusting a distance that the distal end of the second rod extends into the inner cavity.

4. The mechanical transmission mechanism according to claim 3, wherein the adjusting member is configured to be threadedly connected to the distal end of the second rod, and the position of the distal end of the second rod relative to the proximal end of the link is adjusted by adjusting a distance that the adjusting member is screwed into the distal end of the second rod.

5. The mechanical transmission mechanism according to claim 4, wherein the distal end of the second rod extends into the inner cavity from a first side of the inner cavity, while at least a portion of the adjusting member extends into the inner cavity from a second side of the inner cavity opposite the first side.

6. The mechanical transmission mechanism according to claim 3, wherein the mechanical transmission mechanism further comprises a limiting member that is configured to restrain the adjusting member after the distal end of the second rod is adjusted to a predetermined position relative to the proximal end of the link and to maintain the predetermined position.

7. The mechanical transmission mechanism according to claim 6, wherein the limiting member includes a first limiting portion for limiting translation of the adjusting member.

8. The mechanical transmission mechanism according to claim 6, wherein the limiting member or the second connecting element of the link includes a second limiting portion for limiting rotation of the adjusting member.

9. The mechanical transmission mechanism according to claim 8, wherein the adjusting member includes an extending portion and an end portion, wherein an outer periphery of the end portion of the adjusting member is provided with a series of ridges or ribs distributed along the outer periphery, and the second limiting portion is provided with grooves matching the ridges or ribs of the end portion of the adjusting member, thereby limiting rotation of the adjusting member.

10. The mechanical transmission structure according to claim 6, wherein the limiting member is in snap-fit connection with the link.

11. The mechanical transmission mechanism according to claim 2, wherein the second rod has a rectangular cross section.

12. The mechanical transmission mechanism according to claim 11, wherein the proximal end of the second rod includes a connecting element for connecting to a movable element of the phase shifter or connecting to a linkage mechanism provided between the second rod and the movable element of the phase shifter.

13. The mechanical transmission mechanism according to claim 12, wherein the connecting element is located on any side of the rectangular cross section of the second rod.

14. The mechanical transmission mechanism according to claim 12, wherein the connecting element is capable of being positioned in a plurality of different orientations.

15. The mechanical transmission mechanism according to claim 2, wherein at least a portion of the second rod has a circular cross section.

16. The mechanical transmission mechanism according to claim 15, wherein the at least a portion of the second rod is configured to be threadably connected to the second connecting element.

17. The mechanical transmission mechanism according to claim 16, wherein the second rod is provided with an anti-rotation element for limiting rotation of the second rod after the distal end of the second rod is screwed into a predetermined position in the inner cavity so as to maintain the predetermined position.

18. The mechanical transmission mechanism according to claim 1, wherein the first connecting element and the second connecting element are constructed as one-piece.

19. The mechanical transmission mechanism according to claim 1, wherein the first connecting element and the second connecting element are constructed as separate elements.

20. The mechanical transmission mechanism according to claim 19, wherein the first connecting element and the second connecting element are connected by a hinge, so that the first connecting element and the second connecting element are capable of having different included angles.

21. A base station antenna, comprising:

an actuator;

a phase shifter having a movable element; and the mechanical transmission mechanism according to claim 1, wherein the first rod of the mechanical transmission mechanism is connected to the actuator, and the second rod of the mechanical transmission mechanism is connected to the movable element of the phase shifter or a linkage mechanism provided between the second rod and the movable element of the phase shifter.

22. A mechanical transmission mechanism extending between an actuator and a phase shifter of a base station antenna, wherein the mechanical transmission mechanism comprises:

a rod for moving a movable element of the phase shifter, the rod having a proximal end and a distal end; and a link having a proximal end and a distal end and including a first connecting element for movably connecting with an output member of the actuator and a second connecting element for fixedly connecting with the rod;

wherein a position of the distal end of the rod relative to the proximal end of the link is adjustable, so that a length of the rod extending from the proximal end of the link is adjustable, thereby eliminating a virtual displacement caused by mechanical tolerances from the actuator, the mechanical transmission mechanism, and the phase shifter during adjustment of the phase shifter.

23. The mechanical transmission mechanism according to claim 22, wherein the mechanical transmission mechanism includes an adjusting member for adjusting the position of the distal end of the rod relative to the proximal end of the link.

24. The mechanical transmission mechanism according to claim 23, wherein the mechanical transmission mechanism further comprises a limiting member that is configured to restrain the adjusting member after the distal end of the rod is adjusted by the adjusting member to a predetermined position relative to the proximal end of the link and to maintain the predetermined position.

25. The mechanical transmission mechanism according to claim 24, wherein the adjusting member is constructed as an adjusting screw including an extending portion and an end portion, wherein the extending portion of the adjusting screw is configured to be threadedly connected with the distal end of the rod, so as to adjust the position of the distal end of the rod relative to the proximal end of the link by adjusting a distance that the extending portion is screwed into the distal end of the rod.

26. The mechanical transmission mechanism according to claim 25, wherein the second connecting element of the link includes an inner cavity, wherein the distal end of the rod extends into the inner cavity from a first side of the inner cavity, while the extending portion of the adjusting screw extends into the inner cavity from a second side of the inner cavity opposite the first side.

27. The mechanical transmission mechanism according to claim 26, wherein the rod has a rectangular cross section.

28. The mechanical transmission mechanism according to claim 27, wherein the proximal end of the rod includes a connecting element located on any side of the rectangular cross section of the rod.

29. The mechanical transmission mechanism according to claim 25, wherein an outer periphery of the end portion of the adjusting screw is provided with a series of ridges or ribs distributed along the outer periphery, and the limiting member is provided with grooves matching the ridges or ribs of the end portion of the adjusting screw, thereby limiting rotation of the adjusting screw.

30. The mechanical transmission mechanism according to claim 29, wherein the limiting member further includes a limiting portion that is configured to limit translation of the adjusting screw.

31. The mechanical transmission mechanism according to claim 24, wherein the limiting member is in snap-fit connection with the link.

32. A base station antenna, comprising:

an actuator;

a phase shifter having a movable element; and the mechanical transmission mechanism according to claim 22, wherein the first connecting element of the link of the mechanical transmission mechanism is connected to an output member of the actuator, and the rod of the mechanical transmission mechanism is connected to the movable element of the phase shifter or a linkage mechanism provided between the rod and the movable element of the phase shifter.

* * * * *